United States Patent [19]

Lamb

[11] 3,979,782

[45] Sept. 14, 1976

[54] SWIMMING POOL COVER

[76] Inventor: Joe H. Lamb, 3500 Hillside Lane, Salt Lake City, Utah 84109

[22] Filed: Oct. 6, 1975

[21] Appl. No.: 619,708

[52] U.S. Cl. ..... 4/172.14

[51] Int. Cl.[2] ..... E04H 3/16; E04H 3/18; F16L 21/02

[58] Field of Search ..... 4/172, 172.12, 172.11, 4/172.13, 172.14; 160/272

[56] References Cited

UNITED STATES PATENTS

| | | | |
|---|---|---|---|
| 2,898,607 | 8/1959 | McGuire | 4/172.14 |
| 3,050,743 | 8/1962 | Lamb | 4/172.14 |
| 3,051,232 | 8/1962 | Lamb | 4/172.14 X |
| 3,060,455 | 10/1962 | Lamb | 4/172.14 |
| 3,277,498 | 10/1966 | Kleinband et al. | 4/172.14 |
| 3,747,132 | 7/1973 | Foster | 4/172.14 |

*Primary Examiner*—Henry K. Artis
*Attorney, Agent, or Firm*—Richard F. Bojanowski

[57] ABSTRACT

A protective swimming pool covering apparatus is disclosed wherein the apparatus includes a flexible impervious cover sheet capable of being extended and retracted over a swimming pool. Each lateral side of the cover sheet is adapted with a longitudinally beaded side edge which is slideably held in a longitudinal open channel or track cut into a slideway member fixed to the longitudinal margins of the swimming pool. The longitudinal opening of the slideway means is sized such that it is slightly smaller than the diameter of the beaded side edge such that under normal operating conditions the bead will be slideably held within the track or channel. However, under conditions of excessive lateral stress, the bead will be sufficiently compressed and be pulled through the opening and away from the channel. In addition, the end sections of the slideway means is adapted with a stationary channeled guide piece having a pair of flared end sections and a longitudinal side opening. The stationary guide piece is mounted such that the channels of the guide piece and the slideway means are in aligned registry with each other. The longitudinal side opening of the stationary guide piece is substantially smaller than the longitudinal side opening of the slideway means making disengagement of the bead from the channel opening substantially more difficult than that from the slideway means.

9 Claims, 6 Drawing Figures

FIG. 1.
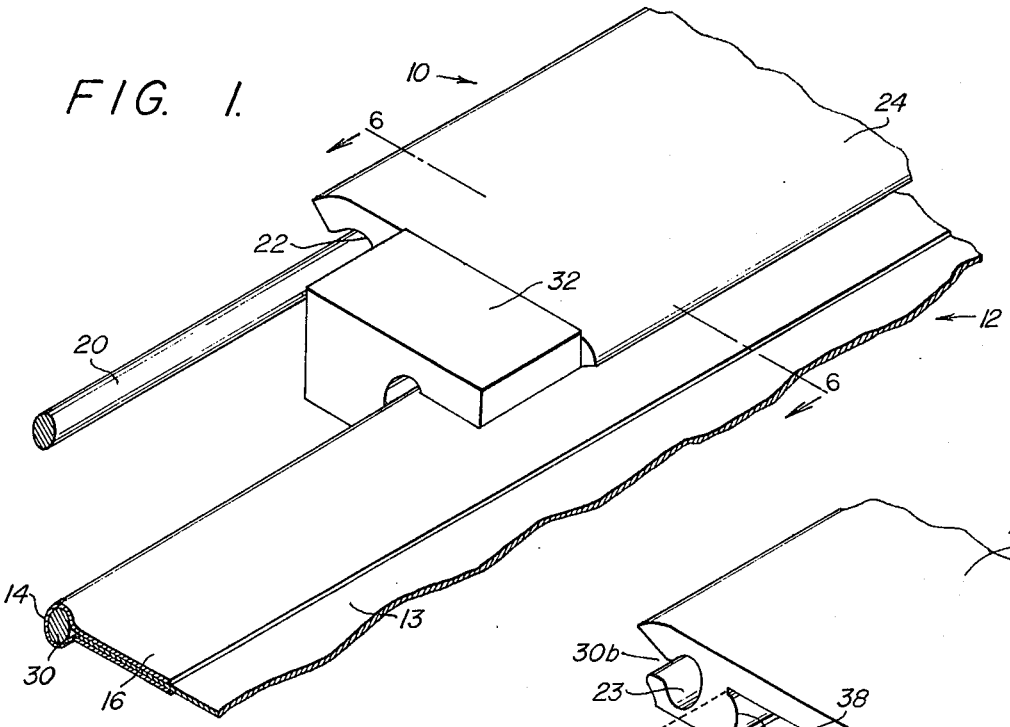
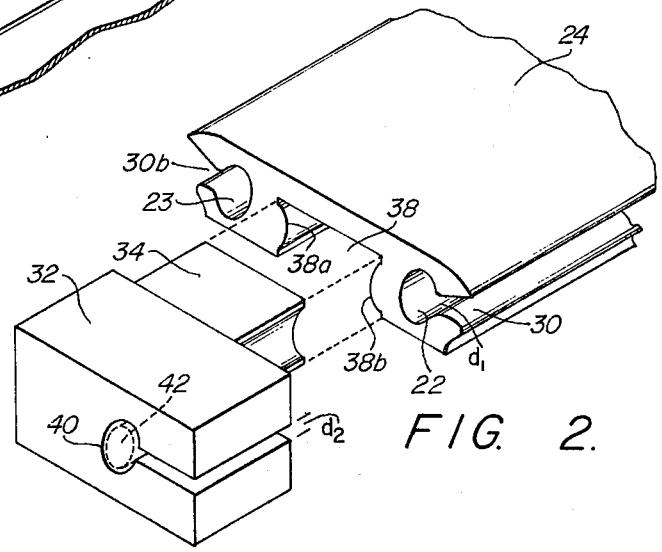
FIG. 2.
FIG. 3.
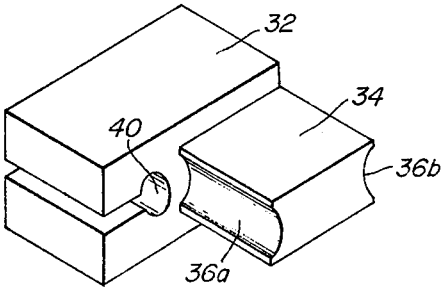
FIG. 5.
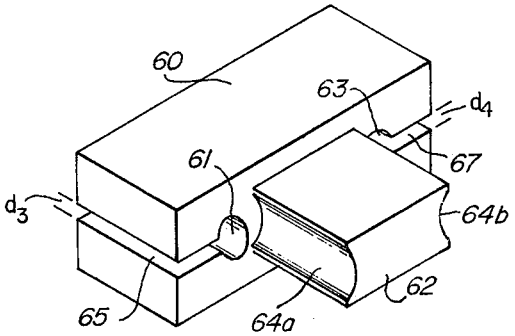
FIG. 4.
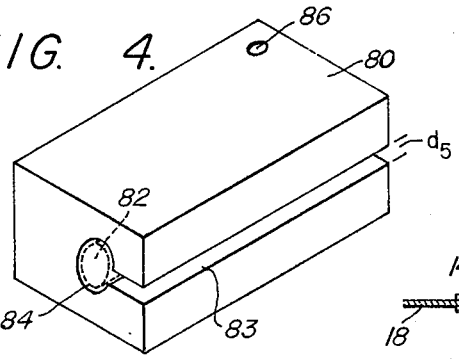
FIG. 6.
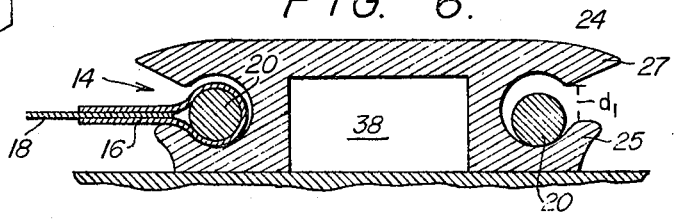

SWIMMING POOL COVER

BACKGROUND OF THE INVENTION

Field:

This invention is directed to a protective swimming pool apparatus and particularly to a channeled slideway means which is mounted to the longitudinal side sections of a swimming pool for releasably holding therein a beaded edge of a swimming pool cover and a means for guiding the introduction and discharge of said beaded edge into and out of the channeled slideway means.

State of the Art

Related Prior Art

The basic protective pool covering of this invention is shown and described generally in the following U.S. Pat. Nos. 3,050,743; 3,051,232; 3,060,455; 3,076,975; and 3,273,171. Other related patents covering various types of pool coverings include the following: U.S. Pat. Nos. 2,580,555; 2,754,899; 2,844,196; 2,898,607; 2,990,556; and 2,958,083.

A channeled slideway means such as that referred to in the instant application is disclosed in the following U.S. Pat. Nos. Design 193,055; 3,051,232; and 3,060,455.

U.S. Pat. No. 3,050,743 discloses a free swinging pilot piece positioned immediately in advance of the inner slideway channels for controlling the feed of the cover beads into such channels and guided discharge from such channels and onto a drum. The free swinging pilot pieces disclosed in the above patent differs from the guide means disclosed and claimed in the instant application in several important aspects, however, of major importance is the fact that the guide means of the instant application is stationary and is used solely for the purpose of insuring that the beaded edge of the cover pool is controllably introduced into and/or discharged from the channel or track of the slideway means. Another distinction is that the claimed guide means contains a means for maintaining the longitudinal side openings of the slideway means and guide means in fixed registry.

Review of Prior Art

The construction and use of small private or residential type swimming pools are on the increase. This increase in pool production and use has resulted in increased hazards to pool owners, their families and to neighborhood children who may inadvertently stumble and fall into the pool. To minimize the hazards related to unattended pools, various types of pool coverings have been proposed for effectively and economically alleviating the attractiveness that open pools apparently have to younger children.

In addition, and as most owners will confirm, pool maintenance problems are encountered if the pools are situated in the vicinity of trees or shrubbery. The removal of leaves, grass, twigs, scraps of paper or other foreign substances from the water is a task which is not only time consuming but also poses the problem that certain of the foreign matter may render the water unsanitary and thereby limit pool use.

Another serious problem, which occurs primarily in the drier climates, is the evaporation and loss of the water contained within the pool along with the loss of chlorine which is normally added for sanitary reasons.

If the pool is heated, loss of heat when the pool is not in use is also minimized. The formation and growth of algae spores is also controlled by covering the pool when it is not being used.

The use of a pool cover also minimizes the danger of mosquitoes or other insects breeding in the water and from the distasteful task of periodically skimming the water to remove insect debris.

Many types of pool covers have heretofore been proposed. Basically these pool coverings are designed to prevent injury or accidental drowning if a child or even an adult should accidentially fall into an uncovered or open swimming pool. To achieve the above, and also to minimize the entry of insects, leaves and other windblown debris into the pool, the pool is adapted with a pool cover which is preferably constructed from an impervious, flexible material designed to fit tightly about the pool. The pool cover is also designed to be extended and retracted expeditiously and preferably be of such design that it will support a child or adult if such person should fall or walk on top of the pool cover.

Although the above cited patents disclose generally coverings which are capable of accomplishing the above, certain operational drawbacks have been found to exist. Specifically, it was found that in certain cases the pool covering would become twisted and skewed during the extending and retracting operation. When this occurred the pool covering could be damaged or in some instances become jammed in the channel or track of the slideway means. When this occurred extensive periods of time were required to overcome the jamming and to release the bead from the channel. In the process, damage to the cover and the slideway means could result. In other instances, the beaded, longitudinal side edge of the pool covering may fail to feed squarely into the channel or track of the slideway means. When this occurs jamming of the pool covering along one side of the track can result and cause tearing or undesirable stretching of the pool cover. The problem of the longitudinal side bead being inadvertently pulled from the channel or track of the slideway means at the time it is first introduced therein is particularly prevalent when the open channel or track is specifically sized to release the bead when an excessive lateral stress or strain is exerted on the pool cover. A particular means is therefor required to insure that the longitudinal beaded edge is guide fed into the track or channel of the slideway means. The above guide means is also desirable to guide feed the draw cord as it passes around the return pulley located on the opposite side of the pool.

Objects of the Invention

To remedy the above shortcomings, it is an object of this invention to provide a swimming pool covering apparatus having a slideway means adapted with a longitudinal opening whereby the opening is sized to hold a longitudinal bead of a pool covering within a channel or track, yet will permit the bead to be extracted or pulled away from the slideway opening whenever an excessive amount of lateral stress is exerted on the pool cover.

Another object is to provide a slideway means adapted to receive and hold a stationary guide means for guiding a pool cover's longitudinal side bead into the channel or track of the slideway means.

Still another object is to provide a guide means adapted with a tongue for fitting into a-groove cut in a slideway means and thereby provide a stationary attachment.

Another object is to provide a guide means capable of being angularly fixed to the slideway means to insure guided feeding or exitting of the beaded edge from the track or channel of the slideway means.

Summary of the Invention

The protective swimming pool covering apparatus as herein described includes a flexible, impervious cover sheet having a beaded longitudinal side edge fixed thereto. A means is also provided for extending and retracting the cover sheet over the swimming pool as may be desired. A channeled slideway means having a longitudinal groove is fixed to each of the longitudinal margins of said swimming pool for slideably holding the beaded longitudinal side edge therein. A stationary channeled guide means is also provided for guiding the pool cover's beaded edge into the slideway means and for maintaining the channels of the slideway means and the guide means in aligned registry with each other. In a preferred embodiment, the channeled slideway means possesses an opening smaller than the diameter of the beaded side edge such that, under normal operating conditions, the bead will be slideably retained within the channel. However, under adverse stress conditions the bead will be compressed sufficiently to permit the bead to be pulled away from the channel and thereby avoid damage to the pool's cover sheet.

BRIEF DESCRIPTION OF THE DRAWINGS

FIG. 1 is a segmented isometric view showing the guide means of this invention stationarily mounted in casual relationship with a slideway means;

FIG. 2 is an exploded view showing the mounting relationship between the guide means and the slideway means shown in FIG. 1;

FIG. 3 is an isometric view of the guide means shown in FIG. 2 but viewed at an angle 90° therefrom;

FIG. 4 shows another embodiment of a stationarily mounted guide means;

FIG. 5 is an isometric view showing another embodiment of a guide means having a pair of guide slots; and FIG. 6 is a lateral cross-section of the slideway means taken along line 6—6 of FIG. 1.

DESCRIPTION OF THE PREFERRED EMBODIMENT

The apparatus of this invention is utilized primarily for the purpose of covering conventional home-owned swimming pools of most any configuration. The swimming pool herein described includes a deck which surrounds a rectangular, sunken pool and a motorized means for extending and/or retracting the cover which extends over the pool. The motorized means is normally enclosed within a housing positioned at one end of the pool. Preferably the housing is enclosed within a well with one end of the pool cover connected to a rotatable drum operatively mounted within the well. Pools of the type hereinabove referred to are described in greater detail in U.S. Pat. Nos. 3,051,232; 3,060,455; 3,050,743; and 3,273,171. The above patents are herein incorporated into this application by reference.

The apparatus of this invention, which is identified generally in FIG. 1 by the numeral 10, is mounted to the sidewall of a rectangular pool or to the top surface of the pool's deck if the pool is irregularly shaped. With either type of pool, the incorporation of the apparatus of this invention facilitates the extension and retraction of the pool's cover.

In the embodiment shown in the drawings, the apparatus of this invention includes a flexible impervious pool cover 12 having a longitudinal beaded side edge 14. The beaded side edge is formed by sewing, gluing or otherwise securing a folded reinforcing flexible member 16 to the longitudinal side edge of the pool cover 18. To provide the beaded side edge 14 with the desired degree of compressability, a draw cord 20 is inserted between the folds of the reinforcing member 16. The draw cord runs the entire longitudinal length of the pool cover and extends outwardly from the front edge of the pool cover and around a pulley rotatably mounted in a plane horizontal to the pool and returns to a collection pulley. Rotatable attachment of the pulley is achieved by securing the pulley either to the wall of the pool or to an extension fixed to the front edge of the apparatus of this invention. The draw cord passes around the pulley and into a return longitudinal open channel or track 22 cut or molded in a slideway member 24 which is fixed to the deck or sidewall of the swimming pool. The end of the draw cord 20 is connected to a motorized spool rotatably mounted in the well. When the motorized spool is energized, the spool is rotated causing the draw cord to be collected thereon. During rotation the draw cord extends the pool cloth cover over the open pool while the draw cord passes around the horizontal pulley, through the return longitudinal channel or track and around the rotating spool.

When the pool cover is being retracted the draw cord collecting spool is disengaged and the motorized drum rotatably mounted within the well is energized causing the drum to rotate and collect the pool cover thereon.

As the cover is being extended or retracted there is always the possibility that some portion of the beaded side edge will become wedged in the longitudinal side openings 30*a* and 30*b* of the slideway member 24. When this occurs one side of the pool cover may be stretched to a point whereby the cover is torn or otherwise damaged. To remedy this undesirable situation the distance "$d_1$" (FIG. 6) of the opening is carefully gauged so that under normal operating conditions the bead 14 and draw cord 20 are held within the channel or track preventing their lateral escape, yet not hinder their longitudinal movement through the channel or track. However, under abnormal or stress conditions, the opening distance $d_1$ is gauged to permit bead 14 and draw cord 20 to be squeezed sufficiently to permit the bead to escape through the opening and thereby prevent damage to the pool cover. Obviously the distance $d_1$ is not fixed to a specified predetermined distance, but will vary depending on the thickness and compressability of bead 14. Generally though, the distance can be calculated or determined empirically, or in the alternative, if the opening is fixed, the thickness and compressability of the bead can be altered to provide release of the beaded side edge under undue stress conditions.

To insure that the bead will enter the center of the track or channel 30*a*, a stationary guide piece 32 is also provided. FIGS. 1–3 inclusive show one type of stationary guide piece, while FIGS. 4 and 5 show a variation or a different embodiment which can be used in the practice of this invention. These variations in design are identified by numerals 60 and 80 respectively.

Referring to guide piece 32, it can be seen that it contains an interlocking appendage 34 having opposed concave side walls 36*a* and 36*b*. The interlocking appendage is designed to fit into a correspondingly shaped underside grooved slot 38 cut into the bottom wall of the slideway member 24 (see FIG. 2). In addition, the guide piece contains a bored opening 40 corresponding substantially in size to the track or channel 30*a* of the slideway means. When the interlocking appendage 34 is inserted into the grooved slot 38, the bored opening 40 is automatically positioned in aligned registry with the channel or track 22 of the slideway means 24. The ground slot 38 will have side walls 38*a* and 38*b* corresponding to the side walls of the interlocking appendage 34. In the embodiment shown, the side walls 38*a* and 38*b* are convexed to correspond with the concave side walls 36*a* and 36*b* of the interlocking appendage 34. The purpose of the guide means is to facilitate entry of the cover's beaded side edge into the bored opening 40 and thereby alleviate the possibility that the beaded side edge will snag or otherwise catch on the front portion of the guide means. It also insures that the beaded edge will enter the center of the track or channel and will not inadvertently become wedged in the longitudinal side openings 30*a*. The entry of the opening 40 is preferably flared as shown in the drawings by the numeral 42. This flaring further insures against snagging and minimizes frictional wear on the pool cover's beaded side edge.

In order to prevent the inadvertent disengagement of the cover's beaded side edge 14 from the bored opening 40 located in the track or channel 22 while the bead is being introduced therein, the distance "$d_2$" of the guide pieces longitudinal opening is substantially smaller than the distance $d_1$ of the slideway longitudinal opening. Preferably the distance $d_2$ is from a 20% to 80% less than the distance $d_1$. For example, if the distance $d_1$ is about 0.5 centimeters the distance $d_2$ will be between about 0.4 and 0.15 centimeters.

The slideway means may be constructed from any durable material such as metals or plastics. Preferably the slideway means is constructed from a lightweight, non-corrosive metal capable of being extruded at minimum costs. The metal aluminum has been found to be most satisfactory. The guide means can be constructed of most any metal or plastic. A synthetic plastic such as nylon has been found to be especially well suited, particularly since it possesses non-corrosive, durable and non-snagging properties. The use of a locking appendage to position and align the guide means with the slideway means, facilitates and minimizes installation errors.

FIG. 5 shows a guide piece 60 similar to that shown in FIG. 3 and hereinabove described. This embodiment contains an additional opening or second channel 61 positioned opposite and parallel to the first channel 63 for receiving and guiding a draw cord 20 extending outwardly as a continuation of the beaded side edge and into the return channel or track 23 of the slideway means. The distances "$d_3$" and "$d_4$" are reduced openings or slots 65 and 67 communicably connected to channels 61 and 63 respectively and are essentially the same as the distance $d_2$ previously described. Likewise, the interlocking member 62 having concave sidewalls 64 and 64b are essentially the same as the interlocking member 34 earlier described. The distances $d_2$, $d_3$ and $d_4$ are at least one-half the diameter of the channels of the guide pieces shown in the drawings and extend outward beyond the limits of the guide pieces side walls.

In FIG. 6 the relationship of the slideway means 24 and the bead 14 is more clearly shown. A distance $d_1$ earlier referred to is identified as the shortest distance between the slideway means lower lip and its overhanging member. To insure that the pool cover is positioned in a plane substantially horizontal to the pool, the slideway means is adapted with a rounded lower lip 25 for supporting the folded reinforced flexible member 16. An upper overhanging section 27 in combination with the rounded lower lip 25 provides the limits for the distance $d_1$.

In FIG. 4 another embodiment of a stationary guide piece 80 is shown. This guide piece, in many respects, is identical to the guide pieces 32 and 60 earlier described. All contain a bored opening and a flared entrance. In guide piece 80 the bored opening is identified by numeral 82 and the flared opening by numeral 84. A longitudinal opening 83 having a vertical distance "$d_5$" is essentially identical to the distances $d_2$–$d_4$ inclusive. However, instead of utilizing an interlocking appendage 62 or 34 the guide piece 80 is designed to be stationarily mounted to a supporting member by means of a bolt (not shown) passing through a vertically bored opening 86. The advantage that this guide piece has is that it may be mounted at an angle to the opening in the slideway means. This permits the pool cover to be directed to a particular section of the rotatable drum as the cover pool is being retracted and collected thereon. By using a bolt or screw to hold the guide means in a stationary position, the angle can be altered at any time to correct and/or redirect the collection of the pool cover on the rotating drum. A similar result can be achieved by angularly molding locking appendage 34 to guide piece 32.

One of the advantages of this invention is that the channelled guide means cannot be improperly installed in relation to the channeled slideway means. For example the interlocking appendage 34 and 62 is designed to fit into the grooved slot 38 and thereby automatically positions the channelled guide means in aligned registry with the channeled slideway means. Likewise the opening 86 would correspond to an opening in the supporting member to insure a properly aligned installation. Replacement of the channeled guide means can also be achieved by the pool cover with ease and without fear that it will be improperly aligned.

Throughout this disclosure reference has been made to locating the guide pieces at the drum end of the slideway means. However, the guide pieces may also be used at the pulley end of the track of the slideway means to guide the draw cord into and away from the track of the slideway means.

Although certain preferred embodiments have been illustrated and described hereinabove, it should be understood that various changes may be made without departing from the spirit and scope of the disclosed inventive concept which is limited only by the claims appended hereto.

I claim:

1. A protective swimming pool covering apparatus including a flexible impervious cover sheet having a beaded longitudinal side edge, a means for extending and retracting said cover sheet over said swimming pool, a slideway means fixed to the longitudinal margins of said swimming pool, said slideway means having a first channel for slideably holding said beaded longitudinal side edge therein, said channeled slideway means having a longitudinal groove centrally cut herein, and a channeled guide means adapted with an interlocking member for fitting into said longitudinal groove and thereby maintain said channels of said slideway means and said guide means in aligned registry with each other.

2. The protective swimming pool apparatus of claim 1 wherein said interlocking member includes a pair of concave side walls and wherein said longitudinal groove includes a pair of convex side walls for receiving said concave side walls.

3. The protective swimming pool apparatus of claim 1 wherein said guide means includes a second channel positioned opposite and paralleled to said first channel, said second channel being adapted to receive a return draw cord extending out from said beaded side edge.

4. The protective swimming pool apparatus of claim 3 wherein each of the channels are in communication with a slot extending outward beyond the limits of said guide means.

5. The protective swimming pool apparatus of claim 4 wherein the ends of said channels are flared.

6. A protective swimming pool covering apparatus including a flexible impervious cover sheet having a beaded longitudinal side edge, a means for extending and retracting said cover sheet over said swimming pool, a channeled slideway means fixed to the longitudinal margins of said swimming pool for slideably holding said beaded longitudinal side edges, said channeled slideway means having an opening slightly less than the diameter of said beaded side edge such that under normal operating conditions said beaded side edge will be slideably retained within said channel and under adverse or stress conditions said beaded side edge will be compressed sufficiently to permit said beaded side edge to pull away from said channel and thereby avoid damage to said cover sheet and a channeled guide means and adjustably stationarily mounted at the end of said channeled slideway means such that said channels are in aligned registry with each other.

7. The protective swimming pool covering apparatus of claim 6 wherein said channeled slideway means includes a groove cut centrally therein and wherein said guide means includes a fixed interlocking member adapted to fit into said groove and thereby maintain said channels of said slideway means and said guide means in aligned registry with each other.

8. The protective swimming pool covering apparatus of claim 7 wherein said channels of said channeled guide means have flared end sections.

9. The protective swimming pool covering apparatus of claim 8 wherein said channeled guide means has a side opening smaller than said opening of said slideway means.

* * * * *